US010760250B2

(12) United States Patent
Ewers

(10) Patent No.: US 10,760,250 B2
(45) Date of Patent: Sep. 1, 2020

(54) METHOD OF RETROFITTING A BATHTUB DRAINAGE PIPE

(71) Applicant: Wayne Ewers, Paterson, NJ (US)

(72) Inventor: Wayne Ewers, Paterson, NJ (US)

( * ) Notice: Subject to any disclaimer, the term of this patent is extended or adjusted under 35 U.S.C. 154(b) by 0 days.

(21) Appl. No.: 16/599,176

(22) Filed: Oct. 11, 2019

(65) Prior Publication Data

US 2020/0040558 A1 Feb. 6, 2020

(51) Int. Cl.
*E03C 1/22* (2006.01)
*E03C 1/292* (2006.01)
*E03C 1/28* (2006.01)

(52) U.S. Cl.
CPC ..... *E03C 1/22* (2013.01); *E03C 1/281* (2013.01); *E03C 1/292* (2013.01)

(58) Field of Classification Search
CPC ..... E03C 1/22; E03C 1/281; E03C 1/292
USPC ..... 4/679
See application file for complete search history.

(56) References Cited

U.S. PATENT DOCUMENTS

| | | | | | |
|---|---|---|---|---|---|
| 1,805,816 | A | | 5/1931 | Fleming | |
| 2,019,779 | A | | 11/1935 | Fleming | |
| 2,705,542 | A | | 4/1955 | Yavitch | |
| 3,896,511 | A | * | 7/1975 | Cuschera | E03C 1/22 4/288 |
| 4,092,745 | A | | 6/1978 | Oropallo | |
| 4,123,810 | A | | 11/1978 | Oropallo | |
| 4,146,939 | A | | 4/1979 | Izzi | |
| 4,332,393 | A | * | 6/1982 | Cuschera | E03C 1/22 277/606 |
| 4,405,159 | A | * | 9/1983 | Spelber | E03C 1/22 285/136.1 |
| 4,622,703 | A | * | 11/1986 | Cuschera | E03C 1/22 277/606 |
| 4,883,590 | A | | 11/1989 | Papp | |
| 4,943,100 | A | | 7/1990 | Emberson | |
| 5,878,448 | A | | 3/1999 | Molter | |
| 6,350,373 | B1 | | 2/2002 | Sondrup | |
| 6,381,775 | B1 | | 5/2002 | Sondrup | |
| 8,146,616 | B2 | | 4/2012 | Dallmer | |
| 8,196,229 | B1 | | 6/2012 | Hickok | |
| 9,366,017 | B2 | * | 6/2016 | Cook | E03F 5/0408 |
| 9,422,708 | B2 | | 8/2016 | Hull | |
| 2007/0204399 | A1 | | 9/2007 | DeGooyer | |
| 2011/0067174 | A1 | | 3/2011 | Schafer et al. | |

* cited by examiner

*Primary Examiner* — Huyen D Le
(74) *Attorney, Agent, or Firm* — Michael J. Feigin, Esq.; Feigin and Fridman LLC

(57) ABSTRACT

A method of retrofitting a drainage pipe is disclosed. The method provides removing a pre-existing bathtub drain of a pre-existing bathtub drainage system to expose the concrete-encased drainage pipe, attaching a gasket to an exposed end of the concrete-encased drainage pipe, attaching a drain body to the gasket, attaching a strainer to the drain body, and attaching the drain body to the concrete-encased drainage pipe via the gasket. The drain body and gasket create a water-tight seal with and between the concrete-encased drainage pipe when attached. The method enables a user to convert a pre-existing bathtub drainage pipe to a shower drainage pipe without the added necessity of digging into the concrete surrounding the pre-existing drainage pipe below the pre-existing bathtub drain in order to place a small piece of modern piping material and a secure fastener below the body of the shower drain.

16 Claims, 7 Drawing Sheets

METHOD OF RETROFITTING A BATHTUB DRAINAGE PIPE

FIELD OF THE DISCLOSED TECHNOLOGY

The disclosed technology relates to a method of retrofitting a drainage pipe. More specifically, the disclosed technology relates to a method of retrofitting a concrete-encased drainage pipe adapted for a bathtub drain for use with a shower drain.

BACKGROUND OF THE DISCLOSED TECHNOLOGY

Today, many apartment owners are attempting to sell their apartments as condominiums ("condos"). In order to raise the market value of their apartments, these owners often try to modernize their apartments as much as possible. Many of these improvements focus on modernization of bathroom and washroom facilities, including replacing bathtubs with showers.

If the building is relatively old and has worn-down drainage pipes, this replacement process can often prove to be a lengthy and costly affair. In addition to removing the bathtub itself and inserting a shower head, building codes require that the bathtub drain be replaced with one adapted for shower use and that the shower drain be properly attached with a watertight seal. This necessitates more than simply removing the bathtub drain and replacing it with a shower drain: in order to ensure that the drain is sufficiently watertight, a plumber must dig into the concrete surrounding the drainage pipe below the bathtub drain in order to place a small piece of modern piping material and a secure fastener below the body of the shower drain.

FIG. 1 shows a floor containing a drainage pipe and bathtub-adapted drain. As the figure shows, the amount of space used by the bathtub drain is far less than the space used by the shower drain and the piece of piping and the secure fastener. In addition to the extra cost and time incurred by the addition of these many pieces, in some cases, the pre-existing floor area is insufficient to hold all of these pieces, requiring the plumber to dig into the ceiling of the apartment below in order to complete the installation. This entire process leads to a greatly increased price as well as requiring permission being given from neighbors.

Accordingly, there is a need for a method of retrofitting drainage pipes attached to drains adapted for bathtub use with drains adapted for shower use which is less costly and more space efficient.

SUMMARY OF THE DISCLOSED TECHNOLOGY

Disclosed herein is a method of retrofitting a concrete-encased drainage pipe adapted for a bathtub drain in order to be used with a shower drain. In order to carry out this method of retrofitting, in embodiments of the disclosed technology, a pre-existing bathtub drain is removed to expose the concrete-encased drainage pipe. A gasket is then frictionally attached to an exposed end of the concrete-encased drainage pipe, and a drain body adapted for shower use is then connected to the rubber gasket. In embodiments of the disclosed technology, the drain body adapted for shower use is of a height which is less than a height of a retrofit shower drain which requires a separate fastener to be connected to the drainage pipe in a lower position. In some embodiments, the top-most edge of the drain body has a radial flange which is a width twice as large as a longest distance of the drain body, this longest distance being perpendicular to a diameter of the radial flange.

In various embodiments of the disclosed technology, the overall height between the shower floor and the concrete-encased drainage pipe is less than the height which would be used by a drain adaptor which has a drain body adapted for shower use as well as an attached lower radial screw-tightened fastener which is attached to said concrete-encased drainage pipe.

A strainer is fixedly attached to the top-most edge of the drain body, in some embodiments, and is placed concentrically within an area circumscribed by the outermost edge of the radial flange. This radial flange, in embodiments of the disclosed technology, forms a unitary structure with the top-most edge of the drain body, which is fixedly attached to the drainage pipe.

In some embodiments of the disclosed technology, the gasket is sized to fit circumferentially around the drainage pipe and to slide partially through the drain body from above.

In other embodiments of the disclosed technology, a method of retrofitting a concrete-encased drainage pipe adapted for a bathtub drain for use with a shower drain is disclosed herein. In carrying out this method, in some embodiments of the disclosed technology, a pre-existing bathtub drain is removed and the concrete-encased drainage pipe is exposed. A rubber gasket is then frictionally attached to the exposed end of the concrete-encased drainage pipe, and a drain body adapted for shower use is then attached to the gasket. In various embodiments, the top-most edge of the drainage pipe has a radial flange which is of a width which is twice as large as a longest distance of the drain body which is perpendicular to a diameter of the radial flange.

In some embodiments, the drain body adapted for shower use is of a height which is smaller than a height of a retrofit shower drain which requires a separate fastener connected to the drainage pipe in a lower position.

In some embodiments, the drain body is sized to fit circumferentially around the gasket when the gasket is placed around the drainage pipe. In embodiments of the disclosed technology, this arrangement of drain body and gasket creates a water-tight seal when attached to the drainage pipe.

In some embodiments, this method has an additional step of attaching a separate fastener or fasteners to the drain body after the drain body has been attached to the gasket.

The methods above, in some embodiments of the disclosed technology, form a retrofit drain adaptor adapted for shower use which has a gasket, a radial flange, a drain body, and a strainer. In various embodiments, the drain body has a top-most edge which forms a unitary structure with the radial flange and the strainer is fixedly attached to the top-most edge of the drain body and placed concentrically within an area circumscribed by the outermost edge of the radial flange. In some embodiments, the gasket is sized to fit circumferentially around a drainage pipe and to slide partially through the drain body from above. In other embodiments, the drain body is sized to fit circumferentially around the gasket when the gasket is placed around the drainage pipe.

In embodiments of the disclosed technology, the radial flange is of a width which is twice as large as the height of the drainage body.

The drain body and the gasket, in some embodiments, create a water-tight seal when attached to the drainage pipe.

In various embodiments, a separate fastener or fasteners is/are attached to the drain body after the drain body has been attached to the gasket.

In various embodiments of the disclosed technology, the drain body adapted for shower use is of a height which is smaller than the height of a retrofit shower drain which a separate fastener to be connected to the drainage pipe in a lower position.

For purposes of this disclosure, the following definitions are used. "Drain pipe" used interchangeably with "drainage pipe" is defined as "a pipe placed to carry waste water away from the place where it was used and into a sewage system." "Retrofitting" is defined as adding new technology to old systems, adding to a system technology which was not added when said system was manufactured." "Pre-existing" is defined as "existing prior to the carrying-out of the herein method." "Bathtub drain" is defined as "a drain sized and shaped to connect between the floor of a bathtub which rests on a lower floor and between the end of a drainage pipe underneath the floor." "Shower drain" is defined as "a drain sized and shaped to connect between a floor of a shower cubicle and between the end of a drainage pipe underneath the floor." "Expose" is defined as "to make visible by removing something from around or in front of the thing being exposed." "Taper" is defined as "to diminish or reduce in thickness toward one end, or to become narrower from one end to another end."

Any device or step to a method described in this disclosure can comprise or consist of that which it is a part of, or the parts which make up the device or step. The term "and/or" is inclusive of the items which it joins linguistically and each item by itself. "Substantially" is defined as at least 95% of the term being described and/or "within a tolerance level known in the art and/or within 5% thereof. Any device or aspect of a device or method described herein can be read as "comprising" or "consisting" thereof.

DETAILED DESCRIPTION OF EMBODIMENTS OF THE DISCLOSED TECHNOLOGY

The present disclosed technology provides a method of retrofitting a concrete-encased drainage pipe, which is adapted for use with a bathtub drain, such that the concrete encased drainage pipe can be used with a shower drain. The method includes removing a pre-existing bathtub drain to expose the concrete-encased drainage pipe, attaching a gasket to an exposed end of the concrete-encased drainage pipe, and connecting a drain body adapted for shower use to the rubber gasket.

Embodiments of the disclosed technology will become clearer in view of the following description of the figures.

Figure 1:
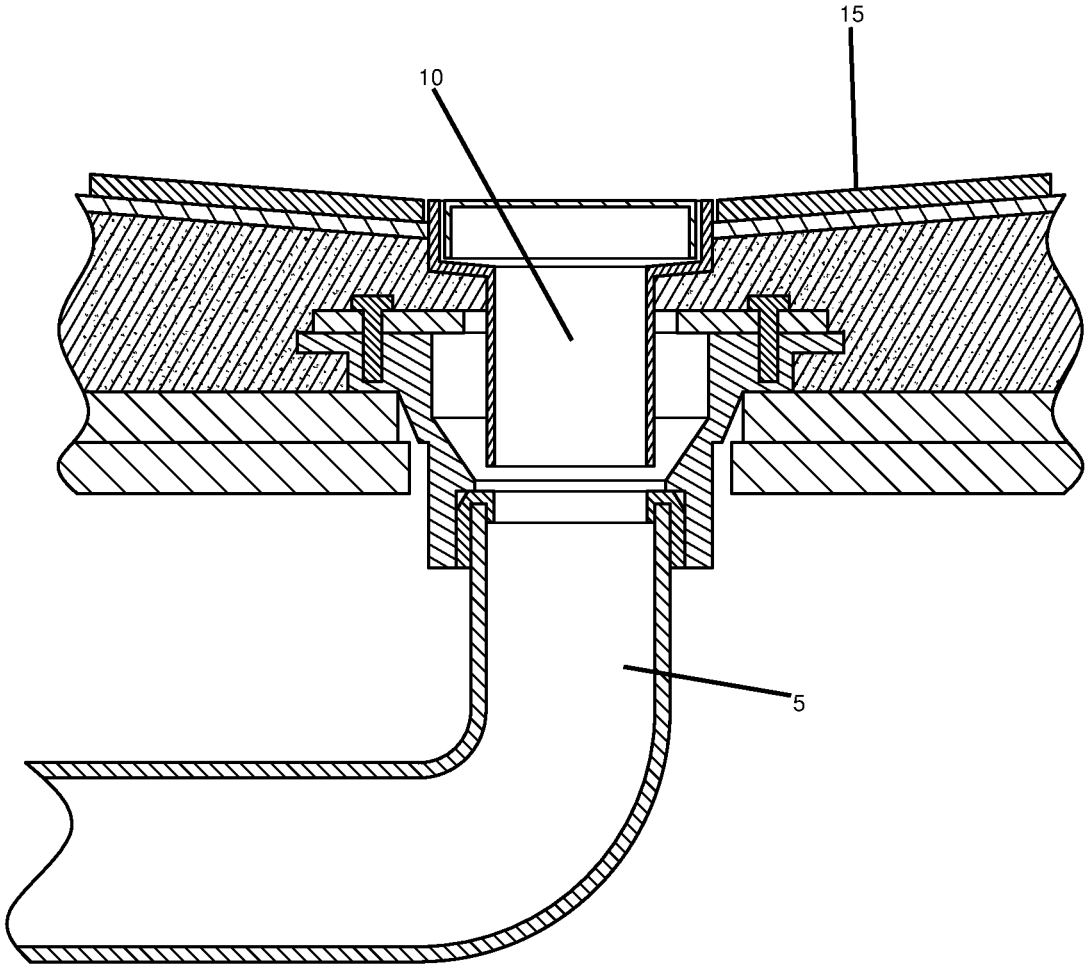
FIG. 1 (Prior Art)
FIG. 1 shows a cross-sectional view of a known conventional pre-existing bathtub drainage pipe system.
Figure 2:
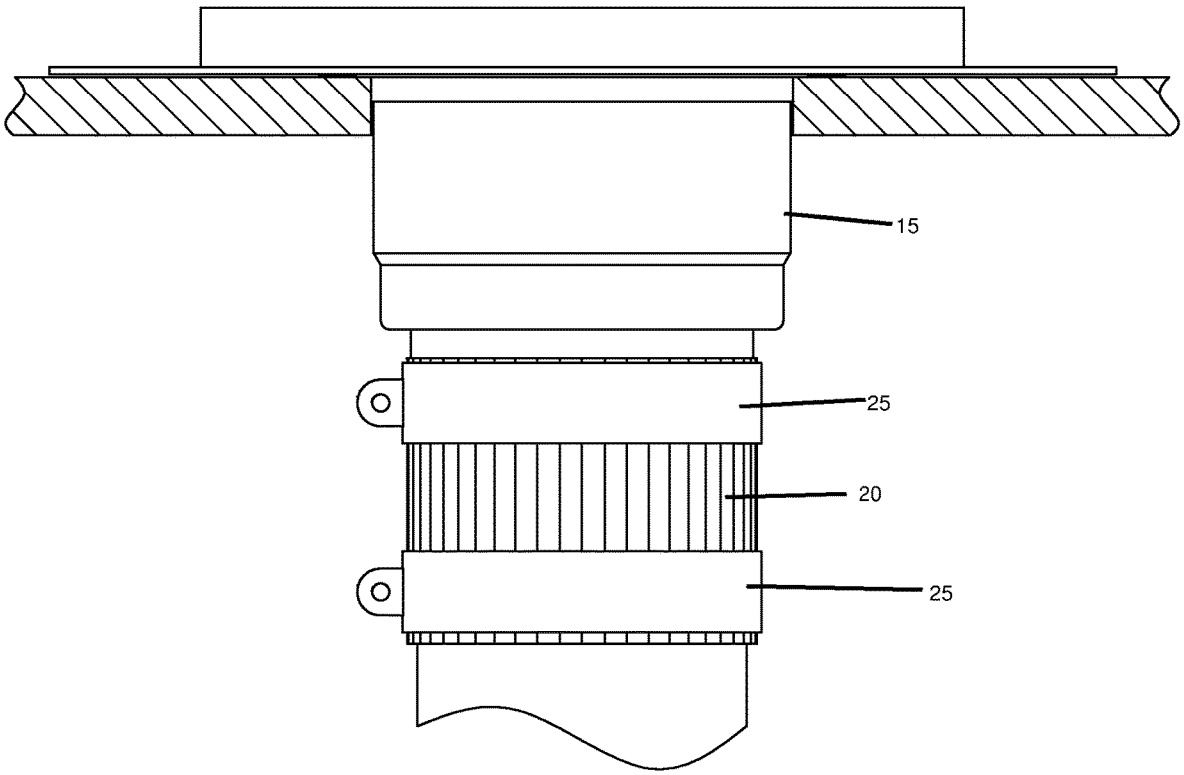
FIG. 2 shows a cross-sectional view of a pre-existing drainage pipe retrofitted with a shower drain according to the method of retrofitting a drainage pipe of the present disclosed technology.

Referring to the figures, FIG. 1 shows a cross-sectional view of a known conventional pre-existing bathtub drainage pipe system. FIG. 2 shows a cross-sectional view of a pre-existing drainage pipe retrofitted with a shower drain according to the method of retrofitting a drainage pipe of the present disclosed technology. FIG. 1 demonstrates the conventional bathtub drainage pipe system setup. In conventional bathtub drainage pipe systems, the drainage pipe 5 and the bathtub-adapted drain 10 is below or within the floor 15. As shown by FIG. 2, the drainage pipe 5 and the shower-adapted drain 15 is also within the floor. Collectively, the figures demonstrate that the amount of space used by the bathtub drain 10 is far less than the space used by the shower drain 15, extra piping 20, and fastener 25.

Figure 3:
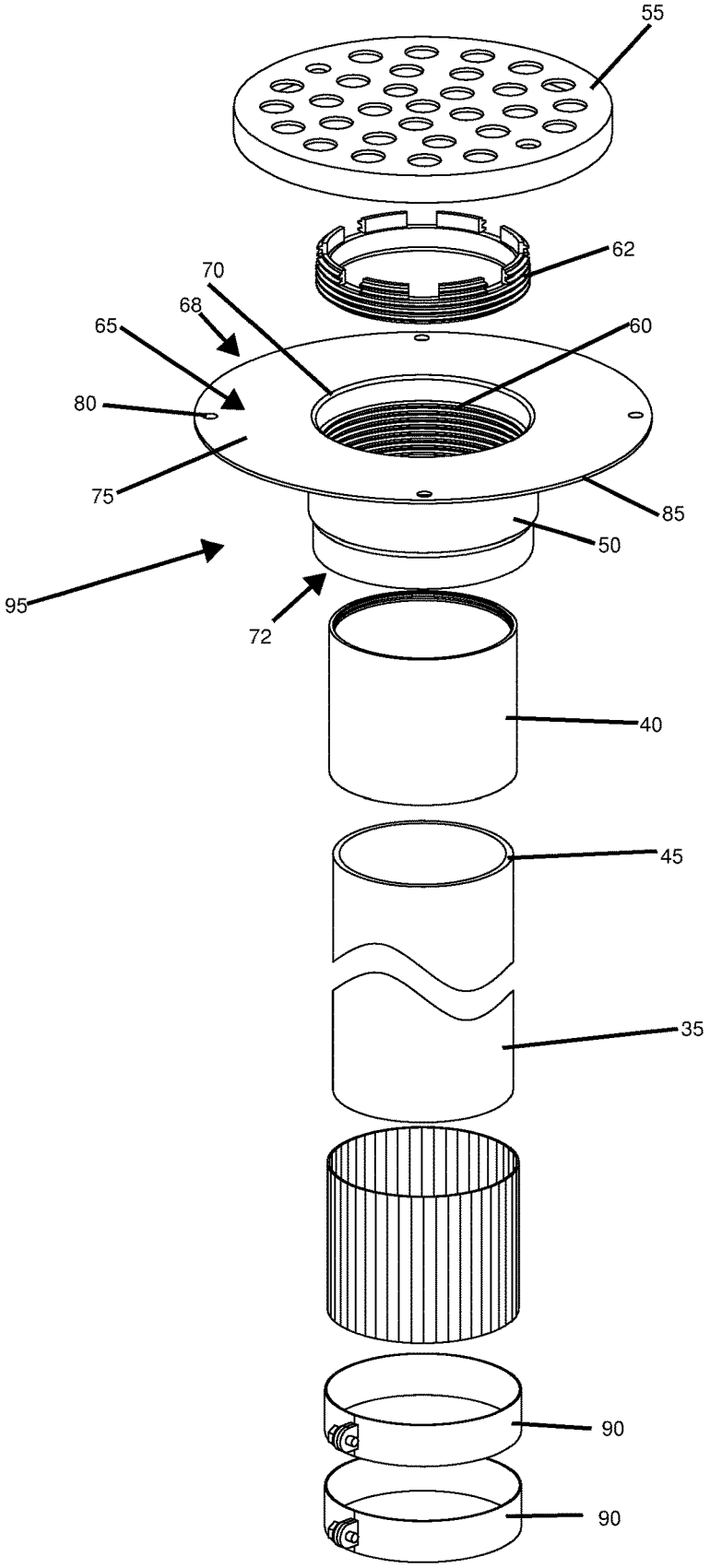
FIG. 3 shows an exploded view of a drainage pipe retrofitted with the method of retrofitting a drainage pipe according to one embodiment of the disclosed technology.
Figure 4A:
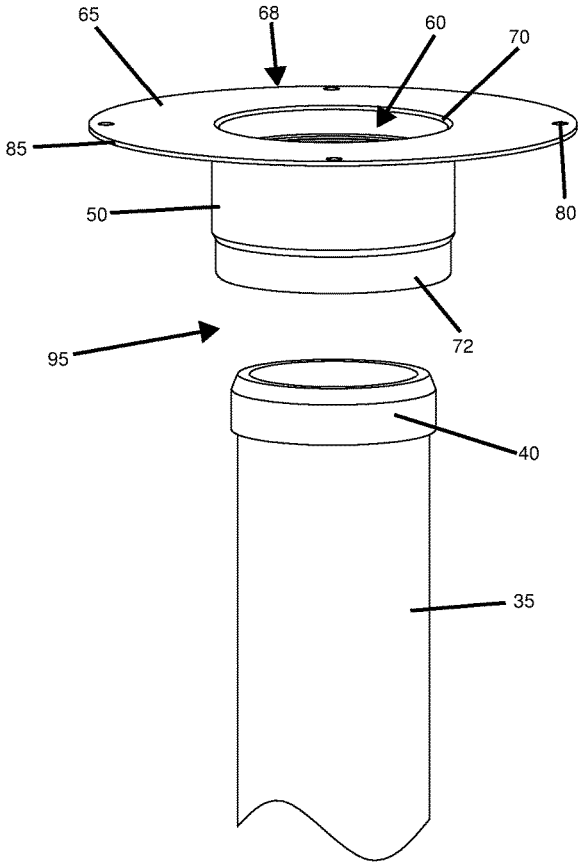
FIG. 4A shows an exploded side view of the drain body and the pre-existing drainage pipe of the method of retrofitting a drainage pipe according to one embodiment of the present invention.
Figure 4B:
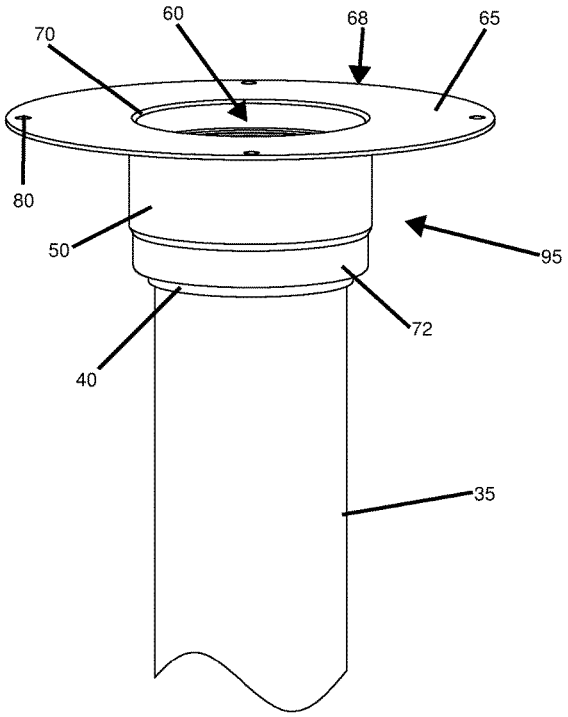
FIG. 4B shows a perspective side view of the drain body of the method of retrofitting a drainage pipe attached to pre-existing drainage pipe according to one embodiment of the disclosed technology.
Figure 5:
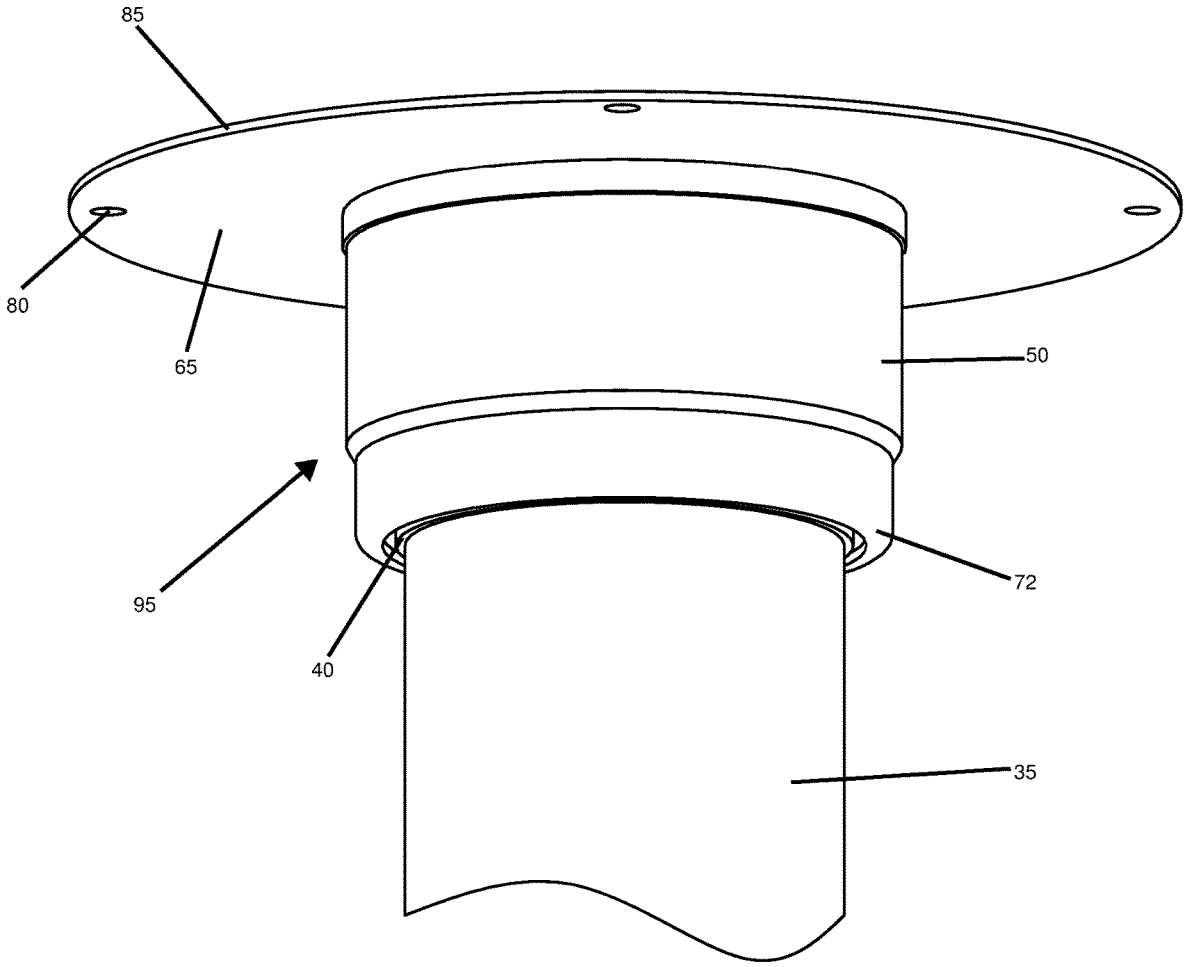
FIG. 5 shows a close-up bottom perspective side view of the drain body of the method of retrofitting a drainage pipe attached to pre-existing drainage pipe according to one embodiment of the disclosed technology.
Figure 6:
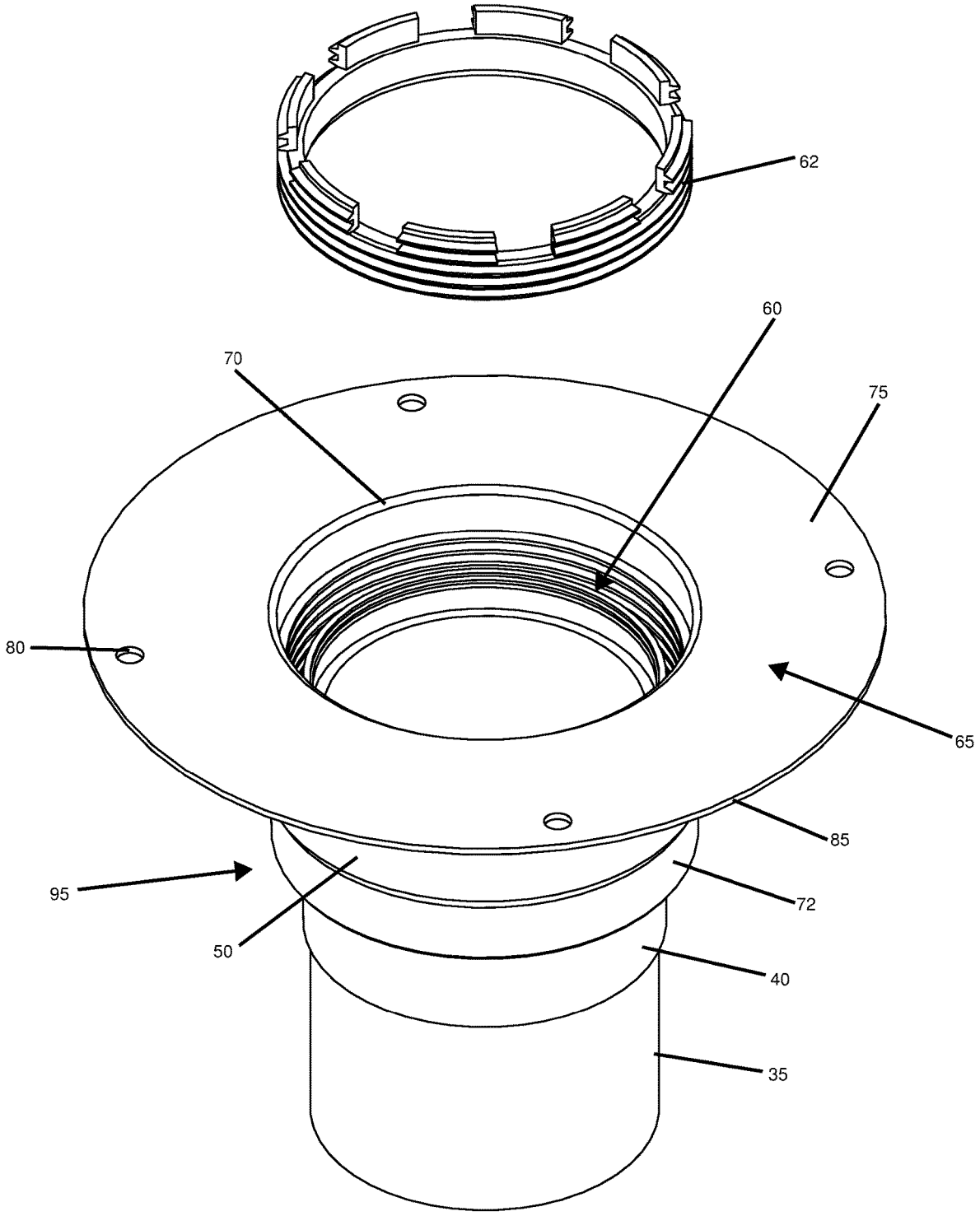
FIG. 6 shows a close-up partial exploded view of the drain body and threaded fastener of the method of retrofitting a drainage pipe according to one embodiment of the present invention.
Figure 7:
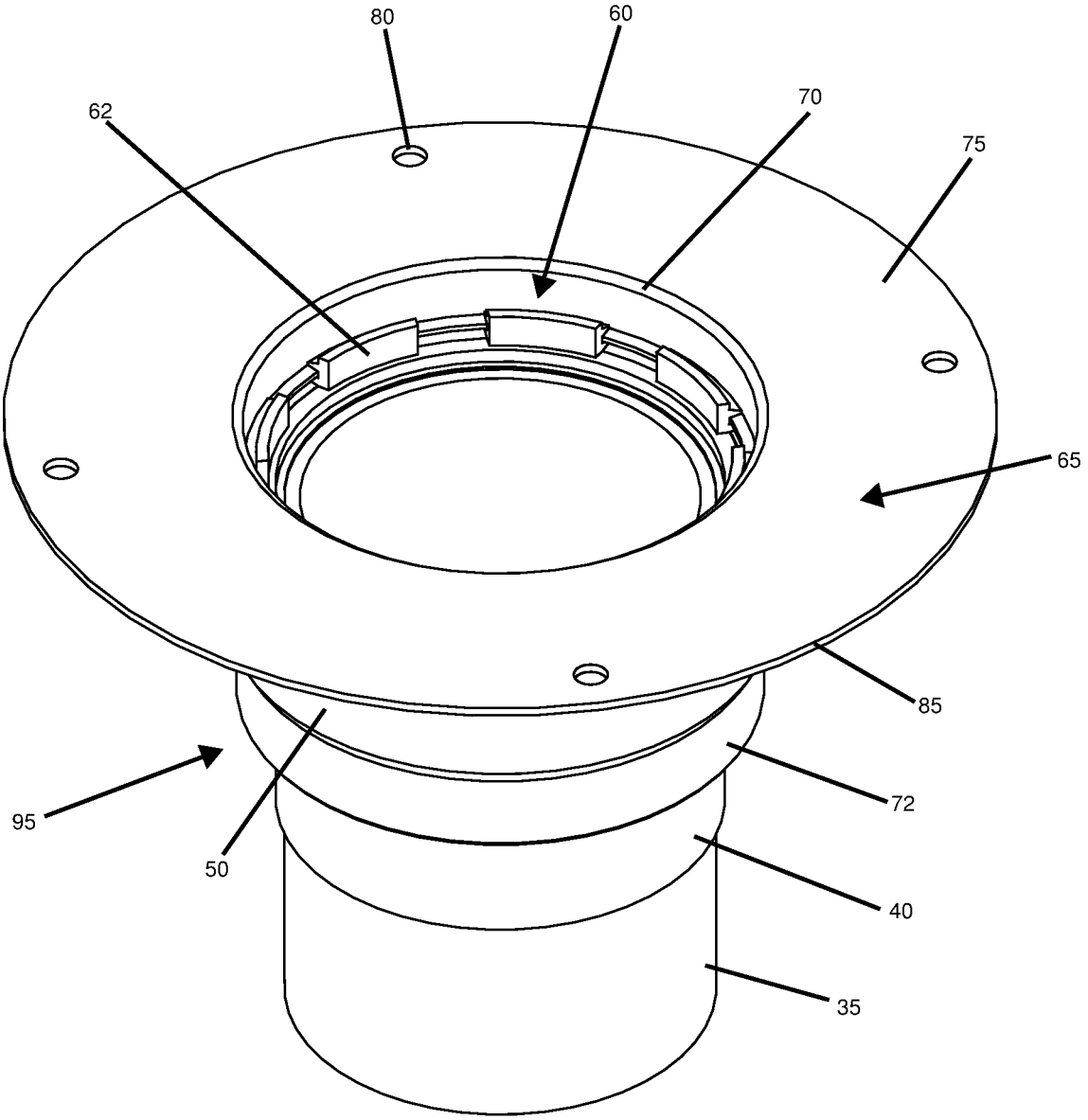
FIG. 7 shows a close-up top perspective side view of the drain body of the method of retrofitting a drainage pipe attached to pre-existing drainage pipe according to one embodiment of the disclosed technology.

Referring now to FIGS. 3, 4A-4B, 5, 6, and 7 simultaneously. FIG. 3 shows an exploded view of a drainage pipe retrofitted with the method of retrofitting a drainage pipe according to one embodiment of the disclosed technology. The present disclosed technology provides a method of retrofitting the concrete-encased drainage pipe system shown in FIG. 1. FIG. 4A shows an exploded side view of the drain body and the pre-existing drainage pipe of the method of retrofitting a drainage pipe according to one embodiment of the present invention. FIG. 4B shows a perspective side view of the drain body of the method of retrofitting a drainage pipe attached to pre-existing drainage pipe according to one embodiment of the disclosed technology. FIG. 5 shows a close-up bottom perspective side view of the drain body of the method of retrofitting a drainage pipe attached to pre-existing drainage pipe according to one embodiment of the disclosed technology. FIG. 6 shows a close-up top perspective side view of the drain body of the method of retrofitting a drainage pipe attached to pre-existing drainage pipe according to one embodiment of the disclosed technology. FIG. 7 shows a close-up partial exploded view of the drain body and threaded fastener of the method of retrofitting a drainage pipe according to one embodiment of the present invention.

The object of the method of the present disclosed technology is to convert a concrete-encased drainage pipe system, which is adapted for a bathtub drain, for use with a shower drain without having to build an extra box to place the shower drain adaptor or digging into the concrete surrounding the pre-existing drainage pipe, which is below the pre-existing bathtub drain, in order to place a small piece of modern piping material and a secure fastener below the body of the shower drain.

In one embodiment, the method includes removing a pre-existing bathtub drain 10 (shown in FIG. 1) of a pre-existing drainage system and exposing the concrete-encased drainage pipe 35 (shown as 5 in FIG. 1), attaching a gasket 40 to an exposed end 45 of the concrete-encased drainage pipe 35, attaching a drain body 50 to the gasket 40, attaching a strainer 55, or retrofit shower drain, to the drain body 50, and attaching the drain body 50 to the concrete-encased drainage pipe 35 via the gasket 40. The drain body 50 and gasket 40 create a water-tight seal with and between the concrete-encased drainage pipe 35 when attached thereto. The drain body 50 includes a height that is less than a height of a conventional retrofit shower drain, which requires a separate fastener connected to the concrete-encased drainage pipe in a lower position to properly install the retrofit shower drain, as shown in FIG. 2.

The drain body 50 is a drain adapted for shower use in that it is specifically sized, shaped, and configured for shower use and not bathtub use. The drain body 50 includes a threaded borehole 60, a radial flange 65, a first end 68 and a tapered second end 72. The threaded borehole 60 extends longitudinally through a center of the drain body 50 from the first end 68 to the second end 72. The threaded borehole 60 is configured to removeably receive a threaded fastener 62 therein so as to provide an added tightening mechanism for fastening the drain body 50 to the gasket 40 and pre-existing concrete-encased drainage pipe 35 in certain embodiments, as shown in FIGS. 6 and 7.

The radial flange 65 extends annularly about a top-most edge 70 of the drain body 50. The radial flange 65 extends perpendicularly outwardly from the drain body 50 and defines a planar face 75 including apertures 80 each configured to receive a fastener therethrough. In one embodiment, the radial flange 65 includes a width that is twice as large as a longitudinal length or longest distance of the drain body 50. The longitudinal length or longest distance is perpendicular to the diameter of the radial flange 65. In another embodiment, the radial flange 65 forms a unitary structure with the top-most edge 70 of the drain body 50. The tapered second end of the drain body 50 is sized to fit circumferentially around the gasket 40, as shown in FIGS. 4B and 5. The drain body 50 is sized and configured to friction fit around the rubber gasket 40 when attached thereto, as shown in FIGS. 4B and 5. The drain body 50 forms a water-tight seal with the gasket 40 when attached thereto.

In one embodiment, the gasket 40 is composed of, or comprises rubber and is frictionally attached to the exposed end of the concrete-encased drainage pipe, as shown in FIG. 4A. In other words, the rubber gasket 40 is sized and configured to friction fit around the exposed end of the concrete-encased drainage pipe. In another embodiment, the gasket 40 is sized to fit circumferentially around the concrete encased drainage pipe 35. The gasket 40 forms a water-tight seal with the concrete encased drainage pipe 35 when attached thereto. In yet another embodiment, the gasket 40 includes a diameter less than a diameter of the drain body, such that the gasket can slide through the borehole 55 of the drain body 50. In alternative embodiments, the gasket 40 is tapered such that the gasket 40 can partially slide through the borehole 55 of the drain body 50 and friction fit therein.

In one embodiment, the method includes fixedly attaching the strainer to the top-most edge 70 of the drain body 50 and is placed concentrically within an area circumscribed by an outermost edge 85 of the radial flange 65. In another embodiment, the method includes attaching one or more fasteners 90 to the drain body 50 after the drain body 50 has been attached to the gasket 40.

In operation, the method of the present disclosed technology, forms an overall height between a shower floor and the concrete-encased drainage pipe 35 that is less than a height used by a conventional retrofit shower drain adaptor which has a drain body adapted for shower use and an attached lower radial screw-tightened fastener which is attached to the concrete-encased drainage pipe.

In one embodiment, the present disclosed technology provides a retrofit drain adaptor 95 adapted for shower use including the gasket 40, the drain body 50, and the strainer 55. In one embodiment, the gasket 40 is sized to fit circumferentially around the concrete-encased drainage pipe via a friction fit and to slide partially through the drain body 50. In one embodiment, the drain body 50 is sized to fit circumferentially around the gasket 40 via a friction fit when the gasket 40 is placed around the concrete-encased drainage pipe. In this way, the drain body 50 and said gasket 40 create a water-tight seal when attached to the concrete-encased drainage pipe.

In one embodiment, the drain body 50 includes the radial flange 65 forming a unitary structure with the top-most edge 70 of the drain body 50. In another embodiment, the radial flange 65 includes a width that is twice the height of the drain body 50.

In one embodiment, the strainer 55 is fixedly attached to the top-most edge 70 of the drain body 50. In another embodiment, the strainer 55 is placed concentrically within an area circumscribed by the outermost edge 85 of the radial flange 65.

In one embodiment, the retrofit drain adaptor 95 includes the one or more fastener 90 for attaching the drain body 50 to the concrete-encased drainage pipe after the drain body 50 has been attached to the gasket 40.

In one embodiment, the drain body of the retrofit drain adaptor 95 includes a height that is smaller than a height of a conventional retrofit shower drain, which requires a separate fastener connected to the concrete-encased drainage pipe in a lower position.

The present technology can be carried out with one or more of the embodiments described. The drawings show embodiments with the understanding that the present description is to be considered an exemplification of the principles and is not intended to be exhaustive or to limit the disclosure to the details of construction. The arrangements of the components are set forth in the following description or illustrated in the drawings.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods, systems, and devices described herein-above are also contemplated and within the scope of the disclosed technology.

I claim:

1. A method of retrofitting a concrete-encased drainage pipe adapted for a bathtub drain for use with a shower drain, comprising the steps of:

removing a pre-existing bathtub drain to expose said concrete-encased drainage pipe without digging into the concrete encasing the drainage pipe;

frictionally attaching a rubber gasket to an exposed end of said concrete-encased drainage pipe; and attaching a drain body adapted for shower use to said rubber gasket;

threadably engaging a first separate fastener with said drain body and said rubber gasket to interconnect said drain body and said rubber gasket to each other;

wherein said drain body adapted for shower use is of a height which is less than a height of a retrofit shower drain, said retrofit shower drain requiring a second separate fastener connected to said drainage pipe in a lower position.

2. The method of claim 1, wherein a top-most edge of said drain body comprises a radial flange which is a width twice as large as a longest distance of said drain body, said longest distance being perpendicular to a diameter of said radial flange.

3. The method of claim 2, wherein an overall height between a shower floor and said concrete-encased drainage pipe is less than a height used by a drain adaptor which has a drain body adapted for shower use and an attached lower radial screw-tightened fastener which is attached to said concrete-encased drainage pipe.

4. The method of claim 3 wherein:

a strainer is fixedly attached to said top-most edge of said drain body and is placed concentrically within an area circumscribed by an outermost edge of said radial flange;

said radial flange forms a unitary structure with said top-most edge of said drain body; and said drain body is fixedly attached to said drainage pipe.

5. The method of claim 4, wherein said gasket is sized to fit circumferentially around said drainage pipe and to slide partially through said drain body from above.

6. A method of retrofitting a concrete-encased drainage pipe adapted for a bathtub drain for use with a shower drain, comprising the steps of:

removing a pre-existing bathtub drain to expose the concrete-encased drainage pipe without digging into the concrete encasing the drainage pipe;

frictionally attaching a rubber gasket to an exposed end of said concrete-encased drainage pipe; and attaching a drain body adapted for shower use to said rubber gasket;

threadably engaging a separate fastener with said drain body and said rubber gasket to interconnect said drain body and said rubber gasket to each other;

wherein a top-most edge of said drain body comprises a radial flange;

wherein said radial flange is of a width which is twice as large as a longest distance of said drain body which is perpendicular to a diameter of said radial flange.

7. The method of claim 6, wherein said drain body adapted for shower use is of a height which is smaller than a height of a retrofit shower drain requiring a separate fastener connected to said drainage pipe in a lower position.

8. The method of claim 7, wherein said drain body is sized to fit circumferentially around said gasket when said gasket is placed around said drainage pipe.

9. The method of claim 8, wherein said drain body and said gasket create a water-tight seal when attached to said drainage pipe.

10. The method of claim 9, further comprising an additional step of attaching a separate fastener or fasteners to said drain body after said drain body has been attached to said gasket.

11. A retrofit drain adaptor adapted for shower use, said drain adaptor comprising:

a gasket;

a radial flange;

a drain body including a first end, a tapered second end, and a threaded borehole extending longitudinally through the borehole between the first end and the tapered second end, said drain body having a top-most edge which forms a unitary structure with said radial flange;

a strainer, said strainer fixedly attached to said top-most edge of said drain body and placed concentrically within an area circumscribed by an outermost edge of said radial flange, wherein said gasket is sized to fit circumferentially around a drainage pipe and to slide partially through said drain body from above.

12. The retrofit drain adaptor of claim 11, wherein the tapered second end of said drain body is sized to fit circumferentially around said gasket when said gasket is placed around said drainage pipe.

13. The retrofit drain adaptor of claim 12, wherein:

said radial flange extends perpendicularly outwardly from said drain body and defines a planar face including an aperture configured to receive a fastener therethrough;

said radial flange is of a width which is twice as large as a longitudinal length of said drain body.

14. The retrofit drain adaptor of claim 13, wherein said drain body and said gasket create a water-tight seal when attached to said drainage pipe.

15. The retrofit drain adaptor of claim 14, further comprising a separate threaded fastener configured to threadably engage said threaded borehole and said gasket to interconnect said body and said gasket to each other.

16. The retrofit drain adaptor of claim 15, wherein said drain body adapted for shower use is of a height which is smaller than a height of a retrofit shower drain requiring a separate fastener connected to said drainage pipe in a lower position.

* * * * *